United States Patent [19]

de Maigret

[11] 4,413,673

[45] Nov. 8, 1983

[54] DEVICES FOR SUPPLYING TUBE EXCHANGERS WITH CLEANING BODIES AND FOR RECOVERING THESE BODIES

[76] Inventor: Hervé C. de Maigret, 310 Stenton Ave., Plymouth Meeting, Pa. 19462

[21] Appl. No.: 434,727

[22] Filed: Oct. 18, 1982

[51] Int. Cl.[3] ..... F28G 1/12

[52] U.S. Cl. ..... 165/95; 15/3.51

[58] Field of Search ..... 165/95; 15/3.5, 3.51, 15/3.52

[56] References Cited

U.S. PATENT DOCUMENTS

| | | | |
|---|---|---|---|
| 616,696 | 12/1898 | Cochran | 15/3.51 |
| 3,288,163 | 11/1966 | Craven | 15/3.51 X |

FOREIGN PATENT DOCUMENTS

| | | | |
|---|---|---|---|
| 2818033 | 8/1979 | Fed. Rep. of Germany | 165/95 |
| 2212525 | 11/1971 | France | 165/95 |
| 54-134860 | 10/1979 | Japan | 165/95 |

*Primary Examiner*—Sheldon J. Richter

*Attorney, Agent, or Firm*—Fleit, Jacobson, Cohn & Price

[57] ABSTRACT

For cleaning the tubes (1) of a heat exchanger (2) through which flows a fluid between an upstream duct (3) and a downstream duct (4), by means of cleaning bodies (5), recourse is had to a sealed box (6) provided with four apertures (J,K,L,M) connected externally so as to define respectively a section (J,K) of the upstream duct and a section (L,M) of the downstream duct, a rotary support (7) mounted in this box and dividing it into two diametrically opposite compartments, two identical baskets (8,9) permeable to the fluid but not to the cleaning bodies and mounted in the two compartments so as to be open solely in the direction of the exchanger, and means (10) for rotating the support by half a revolution so as to switch over the two baskets and their functions (supply of cleaning bodies and collection of same).

9 Claims, 6 Drawing Figures

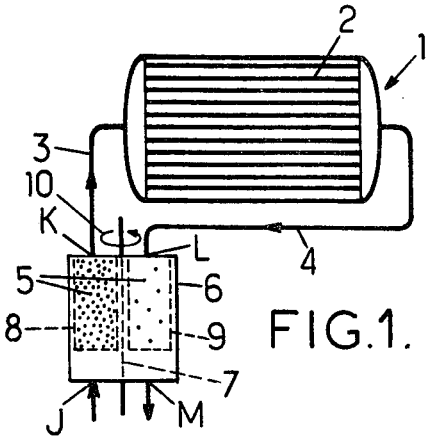
FIG.1.
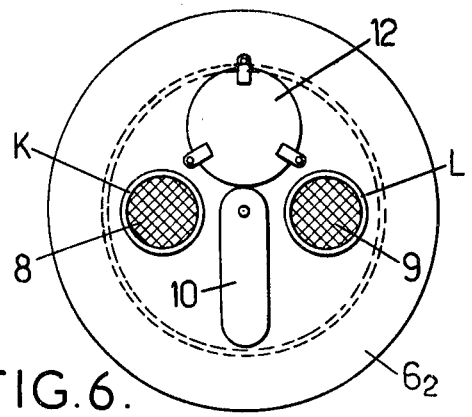
FIG.6.
FIG.2.
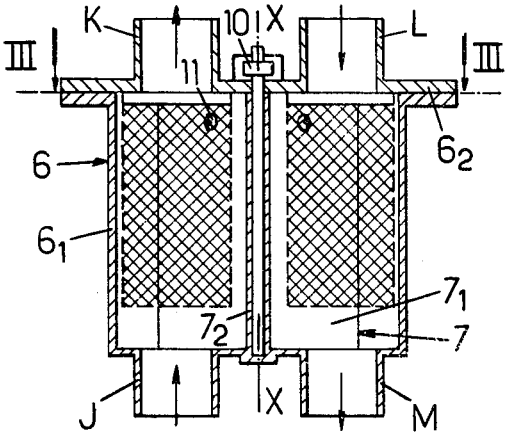
FIG.3.
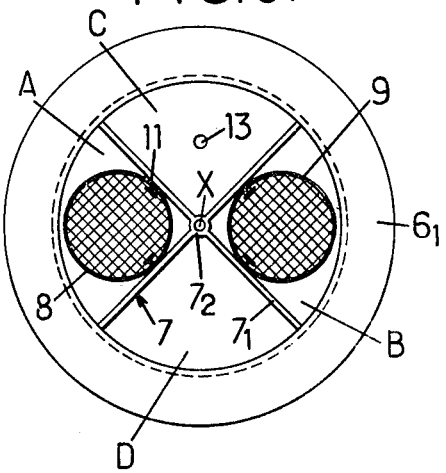
FIG.4.
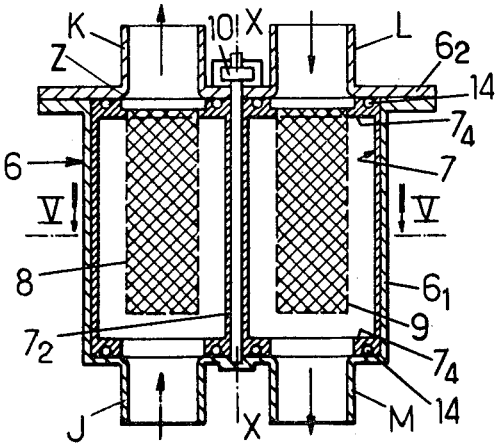
FIG.5.
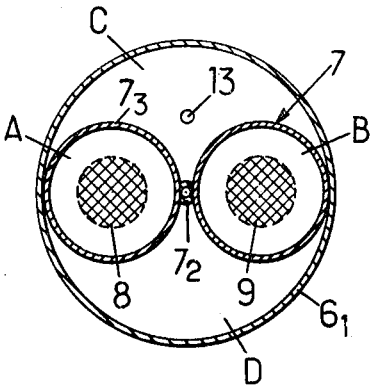

DEVICES FOR SUPPLYING TUBE EXCHANGERS WITH CLEANING BODIES AND FOR RECOVERING THESE BODIES

The invention relates to installations for exchanging heat between two fluids, installations comprising a tube exchanger, more especially of the condenser type, and in which the tubes are cleaned internally by means of solid, generally spherical resilient bodies carried along in these tubes by the fluid which flows therein between an upstream duct for supplying this fluid and a downstream duct for discharging said fluid.

It relates more particularly to the devices used for injecting the cleaning bodies into the upstream duct and for collecting these bodies from the downstream duct by separating them from the carrier fluid.

In the most general embodiments of such devices, the cleaning bodies are separated from the carrier fluid flowing in the downstream duct by their sliding along grids disposed obliquely across this downstream duct and by sucking them by means of appropriate nozzles from the downstream end of said grids into an appropriate chamber. From this chamber, the bodies are taken up again and re-injected into the upstream duct.

Embodiments of this type present certain disadvantages and in particular the following two:

the periodic cleaning of the grids, which is carried out by swinging same so as to reverse the flow direction of the fluid therethrough, leads to the loss of a number of cleaning bodies, namely those jammed between the bars of the grids and discharged downstream during the cleaning considered recycling of the cleaning bodies is accompanied by a fraction of the carrier fluid, which reduces the efficiency of the installation, especially if the volume of this fraction is relatively high and/or the difference between the temperatures of said fluid in the downstream and upstream ducts is relatively high.

To remedy this second drawback, use has already been proposed of a box divided into two compartments by a strainer permeable to the carrier fluid, but not to the cleaning bodies and of pipes, equipped with two three-way valves, adapted so as to mount said box in parallel alternately on a section of the upstream duct and on a section of the downstream duct, this latter section being equipped at its upstream end with oblique separation grids of the kind mentioned above.

Such a solution does away with the second disadvantage mentioned above but not the first and it present others, in particular the following ones:

the duration of the "injection" phase of the cleaning bodies into the upstream duct is limited by the necessity to go over to the "collection" phase of said bodies by actuating the two valves, as soon as the first of these bodies passing through the tubes of the exchanger reaches the level of the separation grids, otherwise these bodies risk creating obstructions by piling up on each other, the circulation of said bodies at the level of the box and its service pipes mounted in parallel on the above duct sections requires having recourse to special measures which consume energy such as the presence of a recycling pump in the upstream pipe and that of a diaphragm creating a pressure drop in the downstream duct section.

The invention allows all these different drawbacks to be overcome.

To this end, the devices for injecting and collecting cleaning bodies in accordance with the invention are essentially characterized in that they comprise: a sealed box having four apertures connected externally so that two of them define axially a section of the upstream duct and the other two define axially a section of the downstream duct; a rotary support mounted in this box and forming therewith two diametrically opposite compartments A and B which define the two above duct sections for one of the angular positions of this rotary support; means for providing a seal between these two compartments; two identical baskets for collecting the cleaning bodies, the lateral wall and/or the bottom of these baskets being chosen so that the fluid, but not the cleaning bodies, can pass therethrough, these bodies being mounted on the rotary support, in respectively the two compartments, so as to be open solely in the direction of the exchanger for the above angular position of said support; and means for rotating this support through 180° about its axis so as to switch the two compartments as well as their baskets.

In the preferred embodiments, recourse is further had to one and/or the other of the following arrangements:

the rotary support mounted in the box forms therewith four compartments, namely the two above compartments A and B and two other compartments C and D staggered angularly by 90° with respect to compartments A and B, the box is equipped with a trap staggered by 90° about the axis of rotation of the support with respect to the apertures of the box, and the means for controlling the rotation of the support are adapted so as to be able to move this latter through three-quarters of a revolution so as to place the openings of the baskets in turn opposite the trap;

the trap according to the preceding paragraph is sufficiently large to let through the baskets, which are removably mounted on the rotary support;

the rotary support comprises a central shaft and four flat identical flaps fixed to said shaft;

the rotary support comprises a central shaft and two tubes with axes parallel to that of the shaft and fixed laterally thereto;

in a device according to the preceding paragraph, the seal between the two compartments A and B is provided by means of four annular seals each interposed between two transverse surfaces formed respectively by an aperture of the box and by the end of a tube, when the rotary support is in its above angular position;

in a device according to the preceding paragraph, each annular seal is housed in a groove formed in one of the two transverse surfaces and the edges of the apertures, formed in the transverse facing surface, with which the seal comes into contact during rotation of the rotary support, are rounded;

the baskets are cylindrical baskets open at one end whose lateral walls and/or bottom are formed by a grid or perforated metal sheet.

The invention comprises, apart from these principal arrangements, certain other arrangements which are used preferably at the same time and which will be more explicitly discussed hereafter.

In what follows, preferred embodiments of the invention will be described with reference to the accompanying drawings in a manner which is of course in no wise limiting.

FIG. 1, of these drawings, shows schematically a heat exchange installation equipped with a device for injecting and collecting cleaning bodies in accordance with the invention.

FIGS. 2 and 3 show such a device respectively in axial section and in cross-section along III—III of FIG. 2.

FIGS. 4 and 5 show a variation of such a device respectively in axial section and in cross section along V—V of FIG. 4.

FIG. 6 shows, in a top view, the box included in any one of the preceding devices.

The installation considered comprises a heat exchanger 1 with parallel tubes 2, more especially of the condenser type.

Tubes 2 receive the fluid F—generally cold water—from a common upstream duct 3 and fluid F leaving these tubes—generally heated—is discharged into a downstream duct 4.

In a way known per se, said tubes are cleaned by causing to pass jointingly therethrough cleaning bodies 5 carried along by the fluid F and formed, preferably but not necessarily, by balls of a resilient material whose diameter is slightly greater than that of the tubes.

To inject these bodies 5 into the fluid F flowing in the upstream duct 3 and to recover them at the outlet of tubes 2, from the downstream duct 4, recourse is had according to the invention to the whole of the following elements:

a sealed box 6 having four apertures J K L and M connected externally so that two of them, JK, define axially a section of the upstream duct 3 and the other two, L M, define axially a section of the downstream duct 4, a rotary support 7 with axis X mounted in this box 6 and forming therewith two diametrically opposite compartments A and B which define the two duct sections JK and LM for the illustrated position of this rotary support, two identical baskets 8 and 9 adapted to collect the cleaning bodies 5, the lateral wall and/or the bottom of these baskets being chosen so that the fluid F, but not the cleaning bodies 5, may pass therethrough, these baskets being mounted on support 7, in respectively the two compartments A and B, so as to be open solely in the direction of exchanger 1 for the angular position illustrated of the support, and means 10 (shown schematically in FIG. 1 by an arrow) for causing the support 7 to rotate through 180° about its axis so as to exchange the two compartments A and B as well as their baskets.

Mounting of these baskets in these compartments is effected so that a seal is provided with respect to the cleaning bodies between the edges of the openings of these baskets and apertures J, K, L and M of box 6.

Moreover, means are provided for sealingly separating the two compartments from each other with respect to the fluid at least outside the brief periods during which the rotary support is rotated.

Operation of the above-described device is as follows:

It is first of all assumed that basket 8, loaded with bodies 5, is in the section JK of the upstream duct 3 (FIG. 1): basket 9, then empty of cleaning bodies, is in the section LM of the downstream duct 4.

Said bodies 5 are then carried along towards exchanger 1 by fluid F flowing in duct 3, then they pass through the tubes of this exchanger while cleaning them and they are finally collected in basket 9.

When all the cleaning bodies 5 have been collected in basket 9, basket 8 is empty.

All that is then required is to rotate the rotary support 7 by half a revolution about its axis X to switch over the two baskets 8 and 9.

The filled basket 9 then has fluid F passing therethrough in the direction opposite the preceding one: it is in its turn gradually emptied of its bodies 5, which are again carried along towards tubes 2 before reaching basket 8, which also has passing therethrough fluid F in the direction opposite the preceding one and gradually fills up with said bodies 5.

When this filling is finished, the two baskets are again switched over and so on.

A timer may be provided advantageously for triggering at regular intervals the rotational movements of support 7.

It should be noted—and this is an important advantage of the present invention—that, if impurities of large size (shells, vegetable debris—) are carried along by the fluid F admitted into the installation, they are stopped on the upstream face of the upstream basket. During subsequent switching over of the two baskets, this face becomes the downstream face of the downstream basket, which results in automatic discharge of said impurities downstream of the installation without their being able to reach the tubes. The proposed construction provides then an efficient protection for the exchanger with respect to the impurities in question and automatic cleaning of the baskets.

Two embodiments of the invention will now be described in greater detail.

In the first embodiment, illustrated in FIGS. 2, 3 and 6, box 6 is formed by a casing cylindrical in revolution $6_1$ with vertical axis X, open at the top with a cover $6_2$ thereon screwed or bolted to a horizontal collar extending horizontally the upper edge of said casing.

The lower edge of this casing is provided with two apertures J, M whose edges are defined by two sleeves cylindrical in revolution extending downwards.

Cover $6_2$ is also provided with two apertures K, L whose edges are defined by two upwardly extending sleeves cylindrical in revolution.

These different sleeves are connected to the rest of ducts 3 and 4 so that the spaces JK and LM inside casing $6_1$ form respectively two sections of these two ducts.

The rotary support 7 is here formed by four flat identical flaps $7_1$ integral with a central shaft $7_2$ extending along axis X so as to be staggered by 90° with respect to each other about this axis. These flaps are dimensioned so as to be able to be rotated with, on the one hand, a small radial clearance between them and the inner cylindrical face of casing $6_1$ and, on the other hand, a small axial clearance between them and the flat transverse internal faces of the bottom and of the cover of said casing, these different clearances being sealed with respect to fluid F by means of appropriate seals such as resilient reeds housed in grooves formed in the edges of the flaps.

Baskets 8 and 9, formed from a grid, perforated metal sheet or any other desirable strainer, are fixed to flaps $7_1$, preferably in an easily removable way, for example by means of rapidly removable fasteners 11 such as bolt—wing nut systems.

The opening of the mesh of the baskets is sufficiently small for the cleaning bodies not to be able to pass therethrough while allowing the fluid F to pass therethrough without creation of an appreciable pressure drop.

The position of these baskets 8 and 9 is chosen so that their openings are facing two apertures K and L for the angular position illustrated of support 7, means being provided for sealing, with respect to the cleaning bodies, between the edges of these openings and those of these apertures.

Cover $6_2$ is equipped with a circular rapid opening trap 12 whose vertical axis is staggered by 90° with respect to those of apertures K and L about axis X and whose opening section is greater than the cross-section of each basket so that these baskets can pass therethrough.

The bottom of casing $6_1$ is provided, underneath trap 12, with a port 13 fitted with a drain cock.

This construction defines inside casing $6_1$, in addition to the two compartments A and B containing baskets 8 and 9, two other compartments C and D staggered by 90° with respect to these compartments A and B about axis X.

The means 10 for rotating support 7, which are here formed by a motor-reduction gear unit coupled to shaft $7_2$ and mounted on cover $6_2$, are then adapted so as to be able to provide the drive in question over successive quarters of a revolution.

Thus, loading and unloading the installation with cleaning bodies is very simply provided.

In fact, a movement of a quarter of a revolution of the rotary assembly from its position illustrated in FIGS. 2 and 3 brings one of the two baskets 8 and 9 opposite trap 12.

This basket may then be filled with cleaning bodies after opening this trap.

Or else, if said basket is already filled with wornout cleaning bodies after prolonged use, the contents may be easily replaced by a new charge, preferably by removing the filled basket itself through the trap 12, emptying same, filling it again and putting it back in place through the trap, which is made possible by the removable fixing of the basket.

To put the new charge of cleaning bodies thus positioned into circuit or back into circuit, it is sufficient to rotate the rotary assembly again through a quarter of a revolution.

The cock fitted to port 13 allows, if necessary, fluid F to be drained from the corresponding compartment.

The four compartment construction presents furthermore with respect to the two compartment construction the following advantage: the sealed separation with respect to fluid F between the two section JK and LM belonging respectively to the upstream 3 and downstream 4 ducts is permanenetly provided, even during rotation of the rotary support.

So that the installation may constantly benefit from the advantage of protection of the exchanger with respect to impurities conveyed by the fluid, even during the relatively short periods of reloading with cleaning bodies, it is sufficient to equip each of the two compartments C and D with strainers serving solely for filtering these impurities and not for recovering the cleaning bodies, since the installation is then free of such bodies.

The second embodiment illustrated in FIGS. 4, 5 and 6 differs from the preceding one only by the construction of the rotary support 7.

This latter is here formed by two identical tubes $7_3$ with vertical axis, fixed to shaft $7_2$ in two diametrically opposite positions with respect to the axis X of this shaft, the diameters of these tubes being chosen so that their wall the furthest away from axis X touches the inner wall of casing $6_1$.

The two axial ends of these tubes $7_3$ are extended inwardly by horizontal collars $7_4$ adapted to travel horizontally facing respectively the upper horizontal face of the bottom of casing $6_1$ and the lower horizontal face of cover $6_2$, at very small vertical distances from these faces.

The small vertical clearance thus defined between said collars and said opposite faces is sealed by means of annular seals 14 housed in complementary annular grooves formed in one or other of the facing surfaces.

To avoid any damage to the seals 14 by contact thereof with the edges of the facing apertures, during rotation of support 7, these edges are rounded.

This is what has been shown at Z in FIG. 4, in which said seals are mounted on the mobile portion: these rounded edges Z correspond then to the connections between the cylindrical inner surfaces of apertures J, K, L and M and the adjacent transverse flat faces of the bottom and of the cover of box 6.

Baskets 8 and 9 are themselves housed in tubes $7_3$ by removably securing their upper edges to the upper collars of these tubes.

Following which and whatever the embodiment adopted, a device is finally obtained for injecting and collecting cleaning bodies whose construction and operation follow sufficiently from what has gone before.

This device presents numerous advantages with respect to those known heretofore, in particular in that it provides automatic protection of the tube exchanger with respect to impurities likely to be transported by the fluid F and in that it overcomes the above-mentioned drawbacks of previously known installations.

In fact, with such a device:

collection of the cleaning bodies is provided without any loss of these bodies and without any recycling of the carrier fluid F in the tubes of the exchanger, there exists no imperative value for the time separating the successive switchings of the baskets: care will in fact be taken to give these baskets sufficient dimensions—and in particular sufficient axial length—so that, even after collection in one of these baskets of all the cleaning bodies used in the installation, this basket still has sufficient free surface for the whole of the flow of the carrier fluid F to pass therethough without hindrance, it is useless to provide special drive or constriction means for ensuring circulation of the cleaning bodies, it is useless to provide three-way valves for modifying any fluid flows.

As is evident and as it follows moreover already from what has gone before, the invention is in no wise limited to those of its modes of application and embodiments which have been more especially considered; it embraces, on the contrary, all variations thereof, particularly:

those where only the two diametrically opposite compartments A and B are provided to the exclusion of compartments C and D, those where each basket (8,9) is reduced to a simple strainer, possibly flat, permeable to the carrier fluid, but not to the cleaning bodies, mounted transversely in a tubular section sealingly connecting two facing apertures (J,K or L,M) of the box so as to divide this section longitudinally into two compartments sealed from each other with respect to the cleaning bodies, but not to the fluid, those where the flat flaps $7_1$ of the construction of FIGS. 2 and 3 are not perpendicular to each other, but inclined with respect to each other by an angle different from 90°, while remaining two by two in the diametrical extension of each other.

I claim:

1. A device for cleaning the tubes (2) of a heat exchanger (1) through which flows a fluid (F) coming from an upstream duct (3) and discharged into a downstream duct (4), comprising a plurality of cleaning bodies (5) adapted to be immersed in the circulating fluid and carried along thereby into the tubes for the purpose of cleaning these latter, and means for injecting said cleaning bodies into the upstream duct and for collecting these bodies from the downstream duct while separating them at that time from the carrier fluid, characterized in that the injection and collection means comprise: a sealed box (6) provided with four apertures (J,K,L,M) connected externally so that two of them (J,K) define axially a section of the upstream duct (3) and the other two (L;M) define axially a section of the downstream duct (4); a rotary support (7) mounted in this box and forming therewith two diametrically opposite compartments A and B which define the two above duct sections for one of the angular positions of this rotary support; means for providing the sealing between these two compartments; two identical baskets (8,9) for collecting the cleaning bodies, in which baskets the lateral wall and/or the bottom are chosen so as to let the fluid, but not the cleaning bodies, pass therethrough, these baskets being mounted on the rotary support, in respectively the two compartments, so as to be open solely in the direction of the exchanger for the above angular position of said support; and means (10) for rotating this support through 180° about its axis (X) so as to switch over the two compartments as well as their baskets.

2. A cleaning device according to claim 1, characterized in that the baskets (8,9) are cylindrical baskets open at one end and whose lateral walls and/or bottom are formed from a grid or perforated metal sheet.

3. A cleaning device according to claim 1, characterized in that the rotary support (7) mounted in the box (6) forms therewith four compartments, namely the two above compartments A and B, and two other compartments C and D staggered angularly by 90° with respect to compartments A and B, in that the box is equipped with a trap (12) staggered by 90° about the axis of rotation of the support with respect to the apertures of the box and in that the means (10) for controlling the rotational movements of the support are arranged so as to be able to move this latter through quarters of a revolution so as to place in turn the openings of the baskets facing the trap.

4. A cleaning device according to claim 3, characterized in that the trap (12) is sufficiently large to let pass therethrough the baskets (8,9) which are removably mounted on the rotary support.

5. A cleaning device according to claim 3 characterized in that the rotary support (7) comprises a central shaft ($7_2$) and four flat identical flaps ($7_1$) fitted to said shaft.

6. A cleaning device according to claim 3, characterized in that each of the other two compartments C and D is equipped with a strainer permeable to the fluid (F) and adapted to retain on its upstream surface the impurities conveyed by this fluid in the direction of the exchanger.

7. A cleaning device according to claim 3, characterized in that the rotary support (7) comprises a central shaft ($7_2$) and two tubes ($7_3$) with axes parallel to that of the shaft and fitted laterally on to this latter.

8. A cleaning device according to claim 7, characterized in that the seal between the two compartments A and B is provided by four annular seals (14) each interposed between two transverse surfaces formed respectively by an aperture (J,K,L,M) of the box (6) and by one end of a tube ($7_3$), when the rotary support (7) is in its above angular position.

9. A cleaning device according to claim 8, characterized in that each annular seal (14) is housed in a groove formed in a transverse surface and in that the edges (Z) of apertures provided in the transverse facing surface, with which the seals come into contact during the rotational movements of the support, are rounded.

* * * * *

UNITED STATES PATENT AND TRADEMARK OFFICE

CERTIFICATE OF CORRECTION

PATENT NO. : 4,413,673

DATED : Nov. 8, 1983

INVENTOR(S) : Herve C. de MAIGRET

It is certified that error appears in the above-identified patent and that said Letters Patent are hereby corrected as shown below:

In the title page, insert:

[73] Assignee: A.T.P. TECHNOLOGY INC., Panama, Republic of Panama

Signed and Sealed this

*Twelfth* Day of *June 1984*

[SEAL]

*Attest:*

GERALD J. MOSSINGHOFF

*Attesting Officer*

*Commissioner of Patents and Trademarks*